United States Patent [19]

Perry

[11] Patent Number: 5,050,462

[45] Date of Patent: Sep. 24, 1991

[54] TOOL AND METHOD FOR DECIPHERING CODES AND RECREATING LOST VEHICLE IGNITION KEYS

[75] Inventor: W. Richard Perry, Summit, Ill.

[73] Assignee: A-Affordable Key & Lock Inc., Summit, Ill.

[21] Appl. No.: 596,762

[22] Filed: Oct. 12, 1990

[51] Int. Cl.[5] ..... B21D 53/42; F05B 19/00

[52] U.S. Cl. ..... 76/110; 81/484

[58] Field of Search ..... 76/110, 101.1; 70/237, 70/252, 278; 81/484

[56] References Cited

U.S. PATENT DOCUMENTS

| | | | |
|---|---|---|---|
| 3,340,752 | 9/1967 | Carney et al. | 81/484 |
| 4,434,686 | 3/1984 | Ryan | 81/484 |
| 4,858,453 | 8/1989 | Namazue | 70/252 |

*Primary Examiner*—Roscoe V. Parker

*Attorney, Agent, or Firm*—Lockwood, Alex, Fitzgibbon & Cummings

[57] ABSTRACT

A method and tool is provided for deciphering electronic codes and recreating lost or missing vehicle ignition keys for vehicle ignition systems in which an ignition key is employed which has a diode containing one of a plurality of possible electronic codes which must be sensed to operate the vehicle. Once the mechanical key code is determined for the cuts on the key by removal of the ignition lock portion, a key blank without cuts but containing a diode having one of the possible electronic codes is inserted into the lock portion, and a tool is inserted into the steering column which has been opened by the removal of the lock portion to move the rack gear to operate the ignition switching assembly to the start position. If the diode code on the key blank is the correct code, the engine will start. If it is the incorrect code, a different key blank containing a diode having another one of the possible codes is inserted in the lock portion, and the foregoing procedure is repeated until the engine starts.

18 Claims, 1 Drawing Sheet

TOOL AND METHOD FOR DECIPHERING CODES AND RECREATING LOST VEHICLE IGNITION KEYS

BACKGROUND AND SUMMARY OF THE INVENTION

The present invention relates to a method for deciphering codes and recreating lost or missing vehicle ignition keys and a tool for same and, more particularly, to a tool and method for use with vehicle ignition systems in which an ignition key is employed which has a diode containing one of a plurality of possible electronic codes, and in which the code is read by an electronic security sensing system to permit the vehicle to be started.

Many vehicles, particularly automobiles, require an ignition key having a plurality of mechanical cuts along one or more edges of the key. The ignition key is inserted into the lock of the vehicle ignition system in order to permit starting and operation of the vehicle. Various attempts have been made in the past, particularly in automobiles, to improve the security of the vehicle ignition systems to discourage theft of the vehicle. These improvements have within the last few years included the vehicle antitheft system (VATS) and/or personal auto security system (PASS).

In the VATS and PASS systems the conventional vehicle ignition key with the usual cuts in one or more edges is further provided with a diode having a computer chip having one electronic code in the diode of some 15 or so possible different codes. When the ignition key is inserted into the ignition lock, the diode with the code is positioned to be read by an electronic sensing system which determines whether or not the code on the key is the correct code for that vehicle. If it is, the vehicle will start and, if it is not it will not start even if the mechanical cuts on the key are correct for that vehicle. Thus, in order to operate the ignition system of a vehicle having VATS or PASS systems, not only must the cuts of the ignition key mechanically fit the lock, but also the electronic code in the key diode must match the electronic code which has been set into the security sensing system of that particular vehicle.

Although such VATS and/or PASS systems do substantially enhance vehicle security, this enhancement also substantially complicates the task of a locksmith who might be called upon to recreate a lost or missing ignition key for an authorized operator of the vehicle. To do this in vehicles employing the VATS and/or PASS systems the steering column must be extensively torn down to remove parts of the ignition system from the column. This includes removal of the steering wheel and air bag, if one is present, the latter of which poses some hazard because the air bag systems contain explosive mechanisms for actuation of the air bag. Once the lock portion of the ignition system which is adapted in normal operation to receive the ignition key has been removed from the steering column, the mechanical key code for the key cuts can be read on the disassembled parts. However, this is only the first step in the VATS and/or PASS ignition systems, because the diode electronic code must still be deciphered in order to recreate the ignition key and operate the vehicle.

In order to determine the electronic diode code using the current procedures, the disassembled steering column as previously discussed is reassembled, a new key blank without a diode is cut according to the mechanical code which has now been identified, and the bottom of the steering column must then be removed to access the ignition wire. Once the ignition wire is accessed, it is unclipped and connected to an electronic interrogator apparatus. When the interrogator has been connected to the ignition wire, it is then set to one code at a time of as many as fifteen possible electronic codes. Each time one of the codes is set in the interrogator, the newly cut ignition key is turned to the start position. Start of the vehicle indicates that the code then set in the interrogator is the correct code for that vehicle. However, if the vehicle does not start, the locksmith must then wait 3–4 minutes, due to a security delay built into the electronic security system, reset the interrogator to another code, and try to start the vehicle again. This procedure must be repeated until the vehicle finally starts.

This current procedure employing the interrogator may take another 20 minutes to an hour to remove the bottom panel of the steering column and perform the interrogation procedure, and another 10–15 minutes to replace the bottom panel of the column. Once the correct electronic code for the specific vehicle is determined, a new key blank having a diode with that electronic code is then cut to also include the proper mechanical cuts.

The aforementioned current procedure employing the electronic code interrogator has the disadvantages of being expensive and bulky, the interrogator costing several hundred dollars and comprising a rather sizeable individual hand carried unit. The procedure utilizing the interrogator also requires added time and effort to tear down the bottom panel of the steering column in order to gain access to the ignition wire for hook up of the interrogator and, after the interrogation is complete, replacement of that panel. Moreover, keys must be mechanically cut not once, but twice.

In the present invention, a method has been discovered which utilizes a simple tool which not only is substantially less expensive and bulky than the aforementioned electronic interrogator, but also substantially reduces the time and effort needed to determine the correct electronic code because it eliminates the need to remove and later replace the bottom panel of the steering column in order to gain access to the ignition wire, the handling of the ignition wire, and the cutting of two keys. In the present invention a simple tool which readily fits in the locksmith's tool box is utilized, while the ignition lock is removed from the steering column, to mechanically operate the ignition switching assembly in order to decipher the electronic diode code without the need to access the ignition wire in the steering column. Also in the invention, a previously cut key is not needed to perform the procedure, thus eliminating the need to cut two keys.

In one principal aspect of the present invention, a method is provided for identifying the electronic code of a vehicle ignition system of the type employing an electronic security diode having a code on the ignition key, and an electronic security system for sensing the correct code on the diode specific to the vehicle from a plurality of possible different codes. The ignition system which is normally operated by the key includes an ignition switching assembly having a start position and which is operated by rack and pinion gears which are in the steering column of the vehicle. The method comprises the steps of removing the lock portion of the ignition system which is adapted to receive the key from the steering column, but leaving the removed lock portion electronically connected to the security system. A first key blank is inserted into the removed lock portion, the blank having a diode bearing one of the possible codes. The rack gear in the steering column is moved to operate the switching assembly to the start position. If necessary, other key blanks are sequentially inserted into the removed lock portion each having a diode bearing other ones of the possible codes, and repeating the movement of the rack gear between each key blank insertion until the vehicle starts.

In another principal aspect of the present invention, the aforementioned method also includes cutting a finished key from a key blank having the correct diode code when the correct code for the subject ignition system is indicated by the start of the vehicle.

In still another principal aspect of the invention, in the foregoing method a tool is inserted into the steering column to engage and rotate the pinion gear in the steering column.

In still another principal aspect of the present invention, in the foregoing method the rack gear is moved by inserting a tool into the steering column, the tool having gear teeth thereon which engage the rack gear to move the rack gear to operate the switching assembly to the start position.

In still another principal aspect of the present invention, a tool is provided for identifying the correct electronic code in a vehicle ignition system of the type employing an ignition key having an electronic security diode thereon with at least one of a plurality of possible codes therein. The tool comprises rotatable gear means adjacent one end of the tool, the gear means having a plurality of substantially arcuately positioned gear teeth which are constructed and arranged to enter the steering column of the vehicle and engage and move a rack gear of an ignition switching system. The tool also includes means secured to the gear means for rotating the gear means when at least some of the gear teeth are engaged with the rack gear.

In still another principal aspect of the present invention, the aforementioned tool also includes a slot adjacent one end of the tool, the slot being constructed and arranged to engage a projection on a pinion gear on an ignition switching system to rotate the pinion gear.

In still another principal aspect of the present invention, the aforementioned gear means is substantially circular and the gear teeth extend over an arc which is less than the total circumference of the circle.

In still another principal aspect of the present invention, a vehicle ignition system of the type employing an electronic security diode having a code on an ignition key, and an electronic security system for sensing the code on the diode specific to the vehicle from the plurality of possible different codes includes a steering column of the vehicle and an ignition switching assembly in the steering column having an off position and a start position. A rack gear in the steering column operates the switching assembly between those positions. A lock portion adapted to receive an ignition key in the normal operation of the vehicle is removed from the steering column, but remains electronically connected to the security system. A key blank having a diode thereon bearing at least one of the possible codes is inserted in the removed lock portion. An opening is present in the steering column from which the lock portion was removed, and a tool is inserted in the steering column through the opening, the tool being rotatable to move the rack gear to operate the switching assembly between its positions.

In still another principal aspect of the present invention, the aforementioned ignition system includes a pinion gear in the steering column for moving the rack gear to operate the switching assembly between its positions, and the tool has engagement means for engaging the pinion gear in the steering column to permit rotation of the pinion gear by the tool.

In still another principal aspect of the present invention, the aforementioned ignition system includes rotatable gear means on one end of the tool which engages the rack gear, the gear means being rotatable to move the rack gear to operate the switching assembly between its positions.

These and other objects, features and advantages of the present invention will become evident upon consideration of the following detailed description.

BRIEF DESCRIPTION OF THE DRAWING

In the course of this description, reference will frequently be made to the attached drawing in which.

DESCRIPTION OF THE PREFERRED EMBODIMENTS

Figure 1:
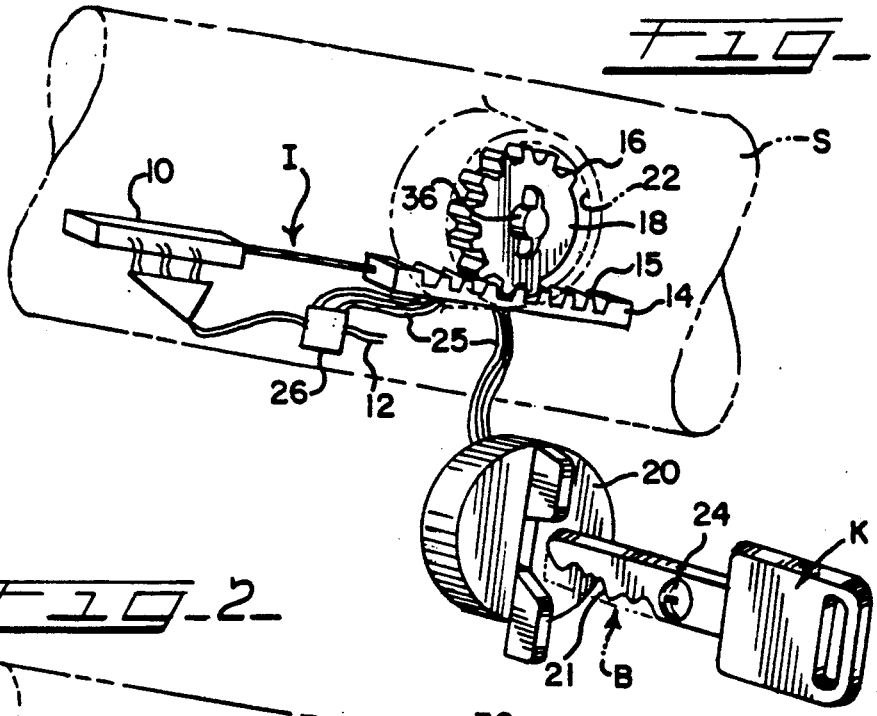
FIG. 1 is a schematic view of a portion of a steering column and an earlier electronic vehicle antitheft ignition system with the lock portion of the system removed from the column, but with the rack and pinion gears of the ignition system remaining in the column.

In FIG. 1, a portion of a steering column S incorporating an earlier version of an electronic security coded ignition system is shown. The steering column S has the usual steering wheel, air bag assembly if one is present, turn signals, etc., none of the latter of which are shown in the drawing for purposes of brevity and because they do not constitute a material aspect of the invention.

The ignition system, generally I, is contained within the steering column S. The ignition system I includes an ignition switching assembly 10 which is capable of being switched through the usual positions, including run, off, accessory, start, etc. When the switching assembly 10 is switched, for example to the start position, it conducts electrical power to the appropriate vehicle engine components, including the starter (not shown), via an ignition conductor or wire 12 in the steering column.

The ignition switching assembly 10 is operated by a rack gear 14 having teeth 15 which are driven by the teeth 16 of a pinion gear 18 which, as shown in FIG. 1, are normally positioned in the steering column S. The pinion gear 16, in turn, is normally driven by the lock portion 20 of the ignition system, the portion which is adapted in normal operation to receive an ignition key K which is cut with the correct mechanical cuts 21 for that ignition lock. The lock portion 20 is mounted over and covers an opening 22 in the steering column S in normal operation. Thus, when the key K is inserted in the lock portion 20 during normal operation of the vehicle and turned to the start position, the lock portion 20 drives the pinion gear 18 and rack gear 14 in the steering column to operate the switching assembly 10 to its desired start position.

In the enhanced security ignition systems which are the subject of the present invention, the lock portion 20 also includes a sensor (not shown) for reading an electronic code which is carried in a computer chip diode 24 on the ignition key K. The code, as read on the diode 24, is transmitted via conductors 25 to an electronic sensing assembly 26 in the ignition conductor or wire 12. The sensing assembly determines whether the code which is set therein is the same as the code in the diode 24. If it is not the same code it opens the conductor 12, but if it is the same code it completes the circuit through the ignition conductor 12 to the starter and other equipment necessary in starting the vehicle engine.

The present invention, as previously stated, is directed to the task of recreating and reproducing the key K with the correct electronic code in the diode 24 and mechanical cuts 21 in the event that the key is lost or misplaced. Both the correct key code for reproducing the mechanical cuts 21 on the ignition key as well as the electronic code in the key diode 24 must be identified if this is to be done. In order to do this, the following initial procedure is followed both in the conventional procedure currently in use and in the initial procedure of the present invention.

Figure 2:
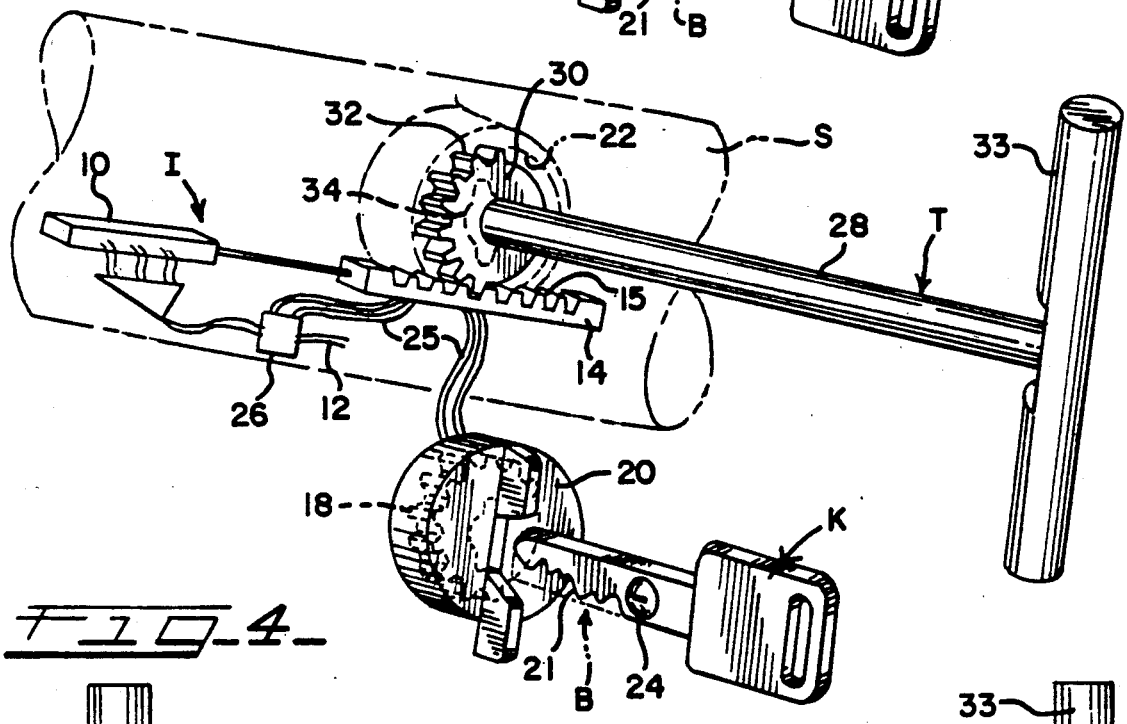
FIG. 2 is a schematic view similar to FIG. 1, but of a more recent system in which the pinion gear of the ignition system is removed with the lock portion.

First, the lock portion 20 of the ignition system I must be removed from the steering column S, as shown in FIGS. 1 and 2. In order to do this, some tear down of the steering column is necessary, both in the existing conventional procedures as well as the procedure employed in the present invention. This includes removal of the steering wheel and, if present, the air bag assembly to permit removal of the lock portion 20. Once the lock portion 20 is removed, as shown in FIGS. 1 and 2, the mechanical key code for the key cuts 21 can be identified because that code is typically stamped either on the inside of the lock portion 20 or on a part of the steering column which is normally covered by the lock portion. Removal of the lock portion 20 also exposes the interior of the steering column through opening 22. The breakdown of the steering column S and removal of the lock portion 20 up to this stage generally takes about 20–40 minutes depending among other things upon the experience of the locksmith and whether or not an air bag is present.

In the current conventional procedure once the mechanical key code has been determined, a key blank is cut with the proper mechanical cuts 21 in accordance with this code, and the steering column S is then reassembled, including replacement of the lock portion 20 over the opening 22. The key K, without a diode 24 on it, which has now been cut to the mechanical code may be utilized through the reassembled lock portion 20 to drive the pinion gear 18 and rack gear 14 in order to operate the switching assembly 10. However, the engine of the vehicle still cannot be started until the correct electronic code of the diode 24 is deciphered so that the circuit through the sensing assembly 26 and ignition conductor 12 can be completed.

In order to determine the correct electronic code in the conventional procedure, it would now be necessary to remove the bottom of the steering column S to expose and obtain access to the ignition conductor or wire 12. Once access is obtained to the ignition wire 12, it is unclipped and connected to the interrogator (not shown) used in the present conventional procedure. This procedure takes another 10–15 minutes.

Once the conductor 12 is coupled to the interrogator, the interrogator is set to one of the several possible electronic diode codes and the key K, without a diode 24 on it but which has the proper cuts 21, is turned to operate the pinion gear 18, rack gear 14 and switching assembly 10. If the code set into the interrogator is the correct electronic code for the vehicle, the vehicle engine will start. However, if it is not the correct code, the locksmith must wait 3–4 minutes, due to a time delay built into the current electronic security ignition systems, until the next try. After this time delay, the locksmith then sets another one of the possible codes on the interrogator and again turns the ignition key K to operate the switching assembly 10 to see if the engine will start. If again the engine does not start, the foregoing steps are repeated until it is found that the correct electronic code has been set into the interrogator because the engine starts.

At this point a second key blank B containing the correct electronic code in its diode 24 is then cut to the correct mechanical key code, the interrogator is disconnected and the steering column bottom is reclosed.

In the current procedure as thus described, interrogation to determine the correct electronic code may take about 20 minutes, including removal of the bottom of the steering column and hook up of the interrogator, if the first code interrogated is the correct code, and up to at least an hour if it is not the correct code. Reclosing of the steering column can take another 10–15 minutes.

Unlike the current conventional procedure which requires the opening of the bottom of the steering column for access to the ignition conductor 12 for connection to the rather expensive electronic interrogator, the present invention eliminates the need for the interrogator and for access to the ignition conductor 12.

In the present invention after the steering column is torn down to the extent that the lock portion 20 has been removed from the steering column S, but is still electronically connected via conductors 25 through the opening 22 to the code sensing assembly 25, as shown in FIGS. 1 and 2, a simple small tool T in accordance with the invention is then used to operate the ignition switch 10. Thus, the need to reassemble the column S or to remove the bottom of the column at this point is unnecessary, as well as the need to cut and use a preliminary but ultimately useless key.

Figure 4:
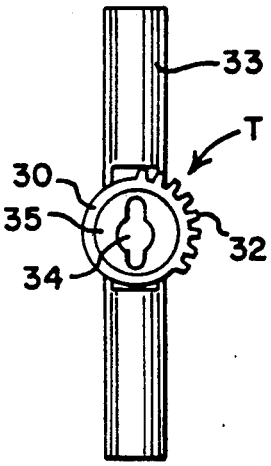
FIG. 4 is an end view of the tool shown in FIG. 3.
Figure 3:
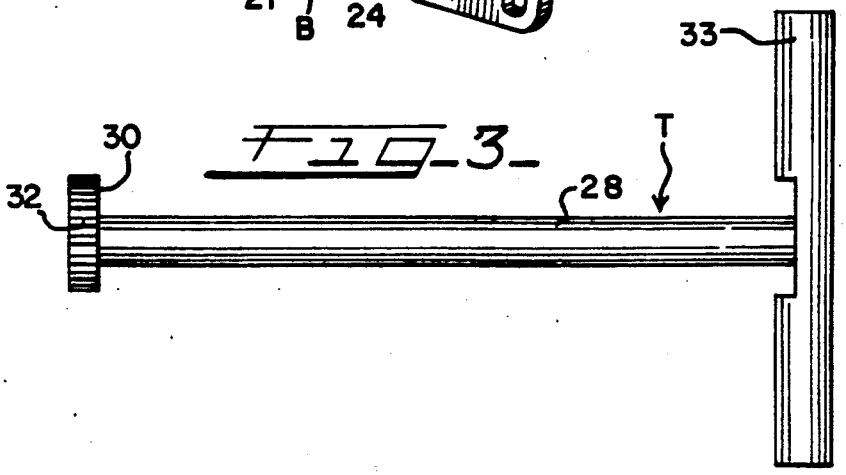
FIG. 3 is a side elevation view of a preferred embodiment of tool of the present invention which is used in the method of deciphering of the electronic code of the ignition system.

The preferred tool T of the present invention, as best shown in FIGS. 3 and 4, comprises a elongate shaft 28 which is preferably cylindrical in cross section, but which may take other cross sectional shapes. A generally circular gear 30 is fixed to one end of the shaft 28 having gear teeth 32 about its circumference. The gear teeth 32 are positioned arcuately over at least a portion of the circular circumference of the gear 30. Although the gear teeth 32 as shown in the drawing preferably do not extend about the entire circumference of the gear 30, they may if desired. Provision is also made to rotate the shaft 28 and gear 30, such as the handle 33 shown in the drawing.

A slot 34 is also preferably formed in the planer end face 35 of the gear 30, as best seen in FIG. 4. The slot 34 is preferably shaped of similar shape to a projection 36 which is part of the ignition pinion gear 18 as shown in FIG. 1. The slot 34 is adapted to receive the projection 36, as will be explained in more detail to follow.

The procedure to be followed in accordance with the method of the present invention depends upon whether the electronic security ignition system is of older or newer vintage.

If it is of an older vintage, reference is made to FIG. 1 in which it will be seen that when the lock portion 20 is removed from the steering column S as shown, the pinion gear 18 will remain in the steering column, but will be accessible through the opening 22 in the column S. In accordance with the invention in order to determine the correct electronic code for the diode 24, a blank key B containing a diode 24 with one of the possible electronic codes in it is inserted into the lock portion 20. Accordingly, its electronic code will be read and transmitted to the code electronic sensing assembly 26 via conductors 25 which are still connected to the lock portion 20.

The tool T of the present invention is now or has previously been inserted through the opening 22 so that the projection 36 on the pinion gear 18 enters the slot 34 on the tool, and the tool is rotated to drive the rack gear 14 and operate the ignition switching assembly 10 to the start position. If the code on the presently inserted key blank diode 24 is the correct code for that vehicle, the code electronic sensing assembly 26 will sense this and will complete the ignition circuit through conductor 12 to start the engine.

If the code on the key blank diode 24 is not the correct code, the blank B is removed and another blank having a different one of the possible electronic codes is inserted into the lock portion 20. After the 3–4 minute delay, the tool T is again rotated to rotate the pinion gear 18 to drive the rack gear 14 and operate the ignition switching assembly 10 to the start position. The foregoing procedure is repeated until a key blank B has been inserted into the lock portion 20 which has the correct electronic code for the particular vehicle. The correct code is indicated by the start of the vehicle.

Once the correct electronic code has been identified, a new key is recreated from that key blank B which contains the correctly coded diode by mechanically cutting the correct cuts 21 on the blank. This mechanical cut code was already identified upon removal of the lock portion 20 from the steering column. All that need be done now is to reassemble the steering column.

If the electronic security ignition system is of a newer vintage, reference is made to FIG. 2 in which it will be seen that the pinion gear 18 is part of the lock portion 20 and is removed from the steering column with the lock portion 20. In this instance, the tool T is inserted into the opening 22 as previously described, but so that the gear teeth 32 will be engaged with the rack gear 14 and its teeth 15 in the absence of the pinion gear. As so positioned, when the tool T is rotated, its gear 30 will drive the rack gear 14 and move the ignition switching assembly 10 to the start position as each selected key blank B is inserted into the lock portion 20. Again, once the correct electronic code is identified, the steering column is reassembled and a new key K having the correctly coded diode 24 and cuts 21 is recreated.

From the foregoing, it will be seen that the tool T is quite simple and compact and, thereby, substantially reduces the bulkiness and expense of the conventional interrogator equipment which is currently used in the conventional procedures. It will also be seen that several time consuming, and in some instances rather complex procedures which are currently a necessity are eliminated, including removal of the bottom of the steering column to gain access to the ignition conductor 12 and its later replacement, coupling of the interrogator to the conductor, and the need to cut key cuts on two key blanks.

It will be understood that numerous modifications may be made by those skilled in the art without departing from the true spirit and scope of the invention, the above described embodiments of the present invention being merely illustrative of an application of the principles of the invention.

I claim:

1. A method of identifying the electronic code of a vehicle ignition system of the type employing an electronic security diode having a code on the ignition key and an electronic security system for sensing the correct code on the diode specific to the vehicle from a plurality of possible different codes, and wherein the ignition system which is operated by the key includes an ignition switching assembly having a start position which is operated by rack and pinion gears which are in the steering column of the vehicle, comprising the steps of:

removing from the steering column the lock portion of the ignition system which is adapted to normally receive the key, but leaving the removed lock portion electronically connected to the security system;

inserting a first key blank having a diode bearing one of the possible codes into the removed lock portion;

moving the rack gear to operate the switching assembly to the start position; and if necessary, sequentially inserting other key blanks each having a diode bearing other ones of the possible codes into the removed lock portion and repeating the aforementioned movement of the rack gear between each such key blank insertion until the vehicle starts.

2. The method of claim 1, including cutting a finished key from a key blank having the correct diode code when the correct code for the subject ignition system is indicated by the start of the vehicle.

3. The method of claim 1, wherein the rack gear is moved by inserting a tool into the steering column to engage and rotate the pinion gear in the steering column.

4. The method of claim 1, wherein the rack gear is moved by inserting a tool into the steering column, said tool having gear teeth thereon which engage the rack gear to move the rack gear to operate the switching assembly to the start position.

5. The method of claim 4, wherein the pinion gear is removed from the steering column with said lock portion of the ignition system.

6. A tool for identifying the correct electronic code in a vehicle ignition system of the type employing an ignition key having an electronic security diode thereon with at least one of a plurality of possible codes therein, said tool comprising:

rotatable gear means adjacent one end of the tool, said gear means having a plurality of substantially arcuately positioned gear teeth which are constructed and arranged to enter the steering column of the vehicle and engage and move a rack gear of an ignition switching assembly;

engaging means also adjacent an end of the tool which engaging means are constructed and arranged to enter the steering column of the vehicle and engage and rotate a pinion gear of the ignition switching assembly, and means secured to said gear means for rotating said gear means and said engaging means either when at least some of said gear teeth are engaged with the rack gear or said engaging means is engaged with the pinion gear.

7. The tool of claim 6, wherein said means for rotating said gear means comprises a handle for manually rotating the gear means.

8. The tool of claim 6, wherein said engaging means includes a slot adjacent said one end of the tool, said slot being constructed and arranged to engage a projection on a pinion gear of an ignition switching assembly to rotate the pinion gear.

9. The tool of claim 8, wherein said slot is on said gear means.

10. The tool of claim 8, wherein said tool includes a handle for manually rotating said gear means and said slot.

11. The tool of claim 8, wherein said gear means is substantially circular and said gear teeth extend over an arc which is less than the total circumference of the circle.

12. A vehicle ignition system of the type employing an electronic security diode having a code on an ignition key and an electronic security system for sensing the code on the diode specific to the vehicle from a plurality of possible different codes, said ignition system comprising:

a steering column of the vehicle;

an ignition switching assembly in the steering column having an off position and a start position;

a rack gear in the steering column for operating the switching assembly between said positions;

a lock portion adapted to receive an ignition key in the normal operation of the vehicle, said lock portion being removed from said steering column, but electronically connected to the security system;

a key blank having a diode thereon bearing at least one of the possible codes, said key blank being inserted in said key lock portion;

an opening in said steering column from which the lock portion was removed; and a tool inserted in said steering column through said opening, said tool being rotatable to move said rack gear to operate the switching assembly between said positions.

13. The ignition system of claim 12, including a pinion gear in said steering column for moving said rack gear to operate the switching assembly between said positions, said tool having engagement means for engaging said pinion gear in said steering column to permit rotation of said pinion gear by said tool.

14. The ignition system of claim 13, wherein said pinion gear has a projection thereon and said engagement means on said tool is a slot which receives said projection.

15. The ignition system of claim 12, wherein said tool includes rotatable gear means at one end thereof which is in engagement with said rack gear, said gear means being rotatable to move said rack gear to operate the switching assembly between said positions.

16. The ignition system of claim 15, including a pinion gear normally positioned in said steering column for moving said rack gear to operate the switching assembly between said positions, said pinion gear being part of said lock portion removed from said steering column, said tool moving said rack gear in the absence from the steering column of the removed pinion gear.

17. The ignition system of claim 12, including a pinion gear normally positioned in said steering column for moving said rack gear to operate the switching assembly between said positions; said tool having engagement means for engaging said pinon gear in said steering column to permit rotation of said pinion gear by said tool; said tool also including rotatable gear means at one end thereof which is engagable with said rack gear, said gear means being rotatable to move said rack gear to operate the switching assembly between said positions when said pinion gear is removed from said steering column.

18. The ignition system of claim 17, wherein said pinion gear has a projection thereon and said engagement means on said tool is a slot which receives said projection.

* * * * *